US006206592B1

(12) United States Patent
Wirth et al.

(10) Patent No.: US 6,206,592 B1
(45) **Date of Patent: *Mar. 27, 2001**

(54) PINCH ROLLER FOR INKJET PRINTER

(75) Inventors: Steven J. Wirth; David A. Neese, both of Escondido; Marni D. Ines; William Golobeff, both of San Diego, all of CA (US)

(73) Assignee: ENCAD, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/353,172

(22) Filed: Jul. 14, 1999

Related U.S. Application Data

(63) Continuation of application No. 09/042,684, filed on Mar. 12, 1998, now Pat. No. 5,938,356.
(60) Provisional application No. 60/040,735, filed on Mar. 12, 1997.

(51) Int. Cl.[7] ..... B41J 13/02
(52) U.S. Cl. ..... 400/636.3; 400/636; 400/637
(58) Field of Search ..... 400/636, 636.3, 400/637, 637.3, 637.4, 637.5, 639, 636.2, 639.1, 641; 347/104, 105

(56) References Cited

U.S. PATENT DOCUMENTS

| | | | | |
|---|---|---|---|---|
| 4,221,489 | | 9/1980 | Engle et al. | 400/636.3 |
| 4,364,683 | | 12/1982 | Shakib et al. | 400/637 |
| 4,630,950 | | 12/1986 | Chu et al. | 400/641 |
| 4,786,193 | * | 11/1988 | Quinn, Jr. | 400/636.3 |
| 4,936,696 | * | 6/1990 | Steppe | 400/636.3 |
| 5,011,313 | | 4/1991 | Sato | 400/636.3 |
| 5,018,655 | | 5/1991 | Koike et al. | 400/636.3 |
| 5,441,354 | * | 8/1995 | Broder et al. | 400/636.3 |
| 5,482,390 | | 1/1996 | Murakami et al. | 400/636.3 |
| 5,580,042 | * | 12/1996 | Taniguro et al. | 400/636.3 |
| 5,938,356 | * | 8/1999 | Wirth et al. | 400/636.3 |

* cited by examiner

*Primary Examiner*—Stephen R. Funk
(74) *Attorney, Agent, or Firm*—Knobbe, Martens, Olson & Bear, LLP

(57) ABSTRACT

An apparatus and method for guiding recording media through a printer comprises a roller unit which is coupled to the printer and which comprises a plurality of roller wheels.

3 Claims, 9 Drawing Sheets

PINCH ROLLER FOR INKJET PRINTER

RELATED APPLICATIONS

This patent application is a continuation of and claims priority to U.S. patent application No. 09/042,684, now U.S. Pat. No. 5,938,356, entitled "Pinch Roller for Inkjet Printer", and filed on Mar. 12, 1998, which further claims priority under 35 U.S.C. Section 119(e) to U.S. provisional patent application entitled, "Pinch Roller For Inkjet Printer," Ser. No.: 60/040,735, and filed on Mar. 12, 1997.

BACKGROUND OF THE INVENTION

1. Field of the Invention

The invention relates to inkjet printers and, more particularly, to an improved method and system for guiding recording media, such as paper, through a printer.

2. Description of the Related Technology

In typical inkjet printing processes, droplets of ink are emitted from ink jet nozzles, or apertures, onto a recording medium, such as paper, which is fed through a printing area of the inkjet printer. The pattern in which the droplets of ink are "sprayed" onto the recording medium is typically directed by computer control.

In many prior art printers, most commonly large format printers, a plurality of single wheel pinch rollers are spread across the width of a printing surface to assist in the guidance of recording media, such as paper, across the platen of the printer during the printing process. Often, however, the alignment of one or more of the rollers in a prior art printer is slightly skewed from the direction of motion of the paper from the feeder apparatus. This can cause a misalignment of the paper as it is fed through the printer and, consequently, can detrimentally affect the printing quality of the printer. In some cases, noticeable wrinkling of the paper may result.

SUMMARY OF THE INVENTION

In one embodiment, the invention comprises a horizontal platen for supporting media to be printed and a support structure mounted above the horizontal platen. A plurality of roller units are coupled to a lower portion of the support structure and extend outward in the direction of media travel. At least one of the roller units comprises a plurality of roller wheels.

In some embodiments, the roller unit comprises a rearwardly extending portion surrounded by a spring, and the rearwardly extending portion is pivotably coupled to the support structure. In addition, the roller unit may be biased downward by a spring extending between a guide rod and the roller unit.

DETAILED DESCRIPTION OF THE INVENTION

The invention is described in detail below with reference to the figures, wherein like elements are referenced with like numerals throughout.

Figure 1:
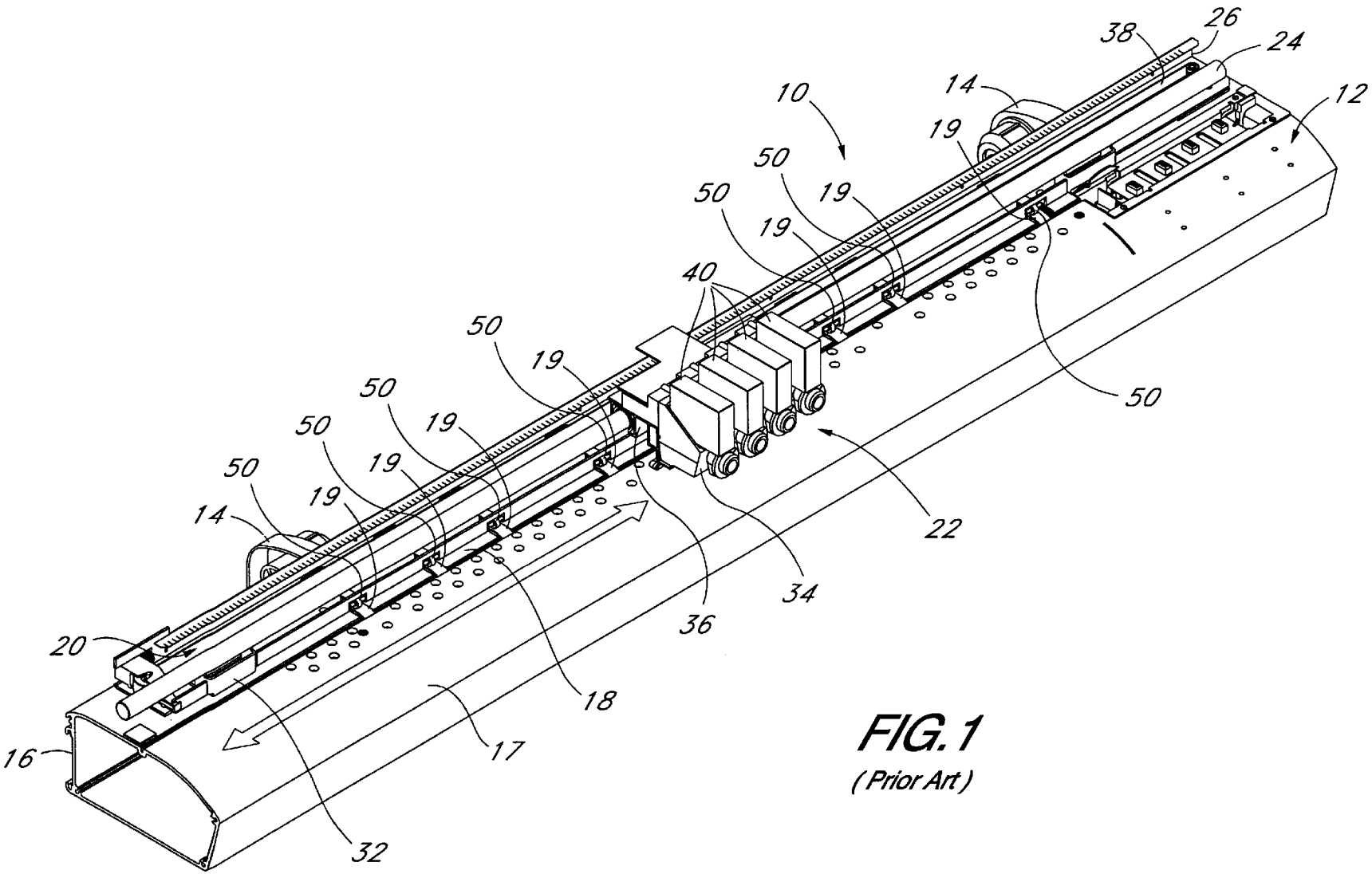
FIG. 1 (Prior Art)
FIG. 1 is a perspective view of several structures of an ink jet printer.

A description of a prior art printer assembly which is used to emit droplets of ink onto a recording medium, as found in typical inkjet printers is described with reference to FIG. 1. Referring to this Figure, a printer carriage assembly 10 is supported on the top face of a printer housing 12, which is a part of a typical printer device. The housing 12 is supported by a pair of legs (not shown) and encloses various electrical and mechanical components related to the operation of the printer/plotter device. A pair of slidable roll holders 14 are mounted to a rear side 16 of the housing 12. A roll of continuous print media (not shown) can be mounted on the roll holders 14 to enable a continuous supply of paper to be provided to the printer/plotter carriage assembly 10. Otherwise, individual sheets of paper may be fed into the rear side 16 of the housing as needed. A portion of a top side 17 of the housing 12 forms a platen 18 upon which the printing/plotting is performed by select deposition of ink droplets onto the paper.

The print carriage support structure 20 is mounted to the top side 17 of the housing 12 with sufficient clearance between the platen 18 and the support structure 20 along a central portion of the platen 18 to enable a sheet of paper which is to be printed on to pass between the platen 18 and the support structure 20. The support structure 20 supports a print carriage 22 above the platen 18. The support structure 20 includes a guide rod 24 and a coded strip support member 26 positioned parallel to the longitudinal axis of the housing 12.

The print carriage 22 includes a plurality of printer cartridge holders 34 each with a printer cartridge 40 mounted therein. The print carriage 22 also includes a split sleeve 36 which slidably engages the guide rod 24 to enable motion of the print carriage 22 along the guide rod 24 and to define a linear path, as shown by the bi-directional arrow in FIG. 1, along which the print carriage 22 moves. A motor (not shown) and drive belt mechanism 38 are used to drive the print carriage 22 along the guide rod 24.

The paper is guided from the rear side 16 of the housing 10 under a support structure 20 and across the platen 18 by a plurality of drive rollers 19 which are spaced along the platen 18. In contact with each drive roller 19 is a pinch roller 50, which rests on top of the printing surface as the paper or other media passes across the platen. The pinch rollers 50 help to secure the media to the drive rollers 19 so that accurate and aligned paper advancement occurs. In FIG. 1, the pinch rollers 50 illustrated are typical of those used in prior art printers and include a single, essentially fixed rotating wheel. One drawback with such prior art pinch rollers 50 is that, after they have been attached to the platen 18, the orientation of the single-wheel pinch rollers 50 is not flexible, so as to be able to self-align with the direction of motion of the recording medium as it is fed between the platen 18 and the support structure 20. Therefore, during the manufacture of prior art inkjet printers, painstaking care and precision must be undertaken to ensure that the single-wheel pinch rollers 50 are properly aligned with the direction of motion of the recording medium, and also, that each single-wheel pinch roller 50 is oriented to be parallel to adjacent single-wheel pinch rollers 50.

Figure 2:
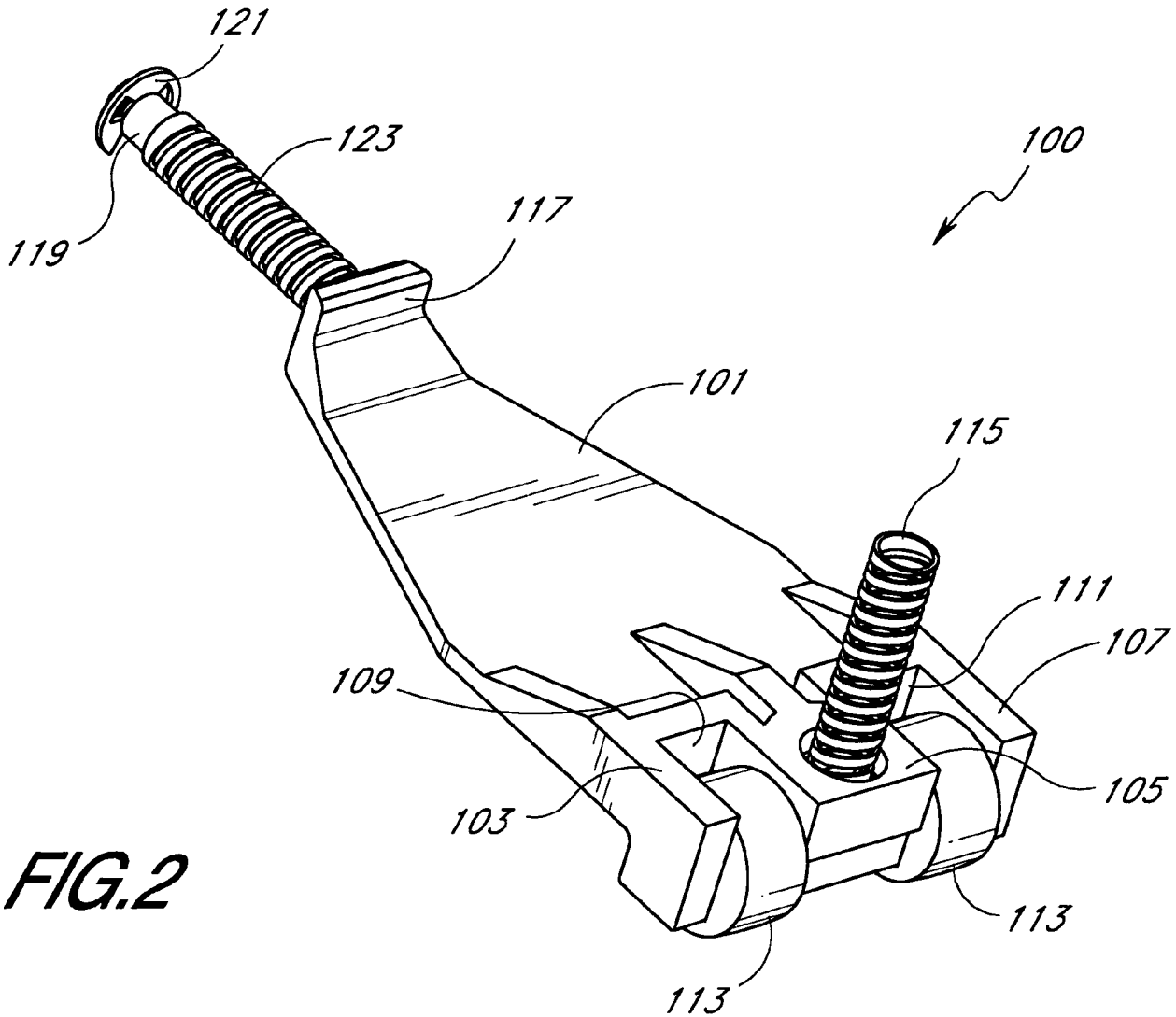
FIG. 2 is a perspective view of a roller unit in accordance with the present invention.

These disadvantages are overcome with the pinch roller of the invention illustrated in FIG. 2 which resiliently and automatically adjusts its alignment to coincide with the direction of motion of the paper or other recording medium as it is fed through the ink jet printer. Referring now to this Figure, a perspective view of a roller unit 100 is shown. The roller unit 100 includes a body 101. Extending outwardly from one side of the body 101 are three finger-like structures, referred to herein as claws, 103, 105 and 107. A channel 109 is formed between the right claw 103 and the middle claw 105. Another channel 111 is formed between the left claw 107 and the middle claw 105. In each of the channels 109 and 111, a roller wheel 113 is positioned such that the roller wheel 113 may freely rotate within each respective channel 109, 111. The roller wheels 113 rotate about an axis provided by an axle (not shown in FIG. 2, designated 112 in FIGS. 4 and 5) which is supported by the claws 103, 105 and 107. In one advantageous embodiment, the roller wheels 113 are slid onto the axle 112, and the axle is snapped into a lipped groove which extends through the center claw 105. The outer claws 103, 107 also include grooves (which may omit the snap fit feature of the center groove) to accept the ends of the axle 112, and prevent it from sliding out to the left or right side. Typically, the roller wheels are made of a light plastic and are loosely coupled to the axle such that they freely rotate about the axle with minimal friction.

Extending upwardly from the middle claw 105 is a first biasing spring 115 which is connected at one end to the middle claw 105 and at the opposite end into a hole (not shown in this Figure) in the guide rod 24 (FIG. 1) of the inkjet printer. This first biasing spring 115 biases the roller unit 100 downwardly such that the roller wheels 113 make contact with the surface of a piece of paper, or other medium, during printer operation.

On the rear end of the body 101 which is opposite to the side where the claws 103, 105 and 107 are located, a wall 117 extends upwardly, substantially perpendicular to the top surface of the body 101, thereby forming a structure which is similar in appearance to a "heel" of a foot. Therefore, this wall 117 will be referred to herein as the heel 117 of the body 101. Integral to the heel 117, and extending outwardly and away from the claws 103, 105 and 107, is a cylindrical rod 119 having one end connected to the heel 117. At its other end, opposite to the end which is connected to heel 117, the cylindrical rod 117 has attached thereto a circular retainer washer 121. As can also be seen from FIG. 2, a second biasing spring 123 is placed over the cylindrical rod 119. The cylindrical rod 119 and spring 123 thus define a common longitudinal axis extending horizontally and rearward from the roller unit 100.

When installed in a printer, the rear end of the roller unit 100 is attached to a bracket wall (not shown in this Figure), of the housing of the printer (not shown in this Figure) by means of the cylindrical rod 119, the retainer washer 121, and the second biasing spring 123. One embodiment of the bracket wall will be described in greater detail below with reference to FIGS. 6–9. The cylindrical rod 119 passes through a hole present in the bracket wall and is thereafter prevented from being extracted from the hole by means of the retainer washer 121. As can be appreciated, the diameter of the retainer washer 121 must be larger than the diameter of the hole of the support wall such that it prevents the cylindrical rod 119 from being pulled out of the hole of the support wall. The support wall (not shown) is positioned between the retainer washer 121 and the end of the second biasing spring 123.

Figure 3:
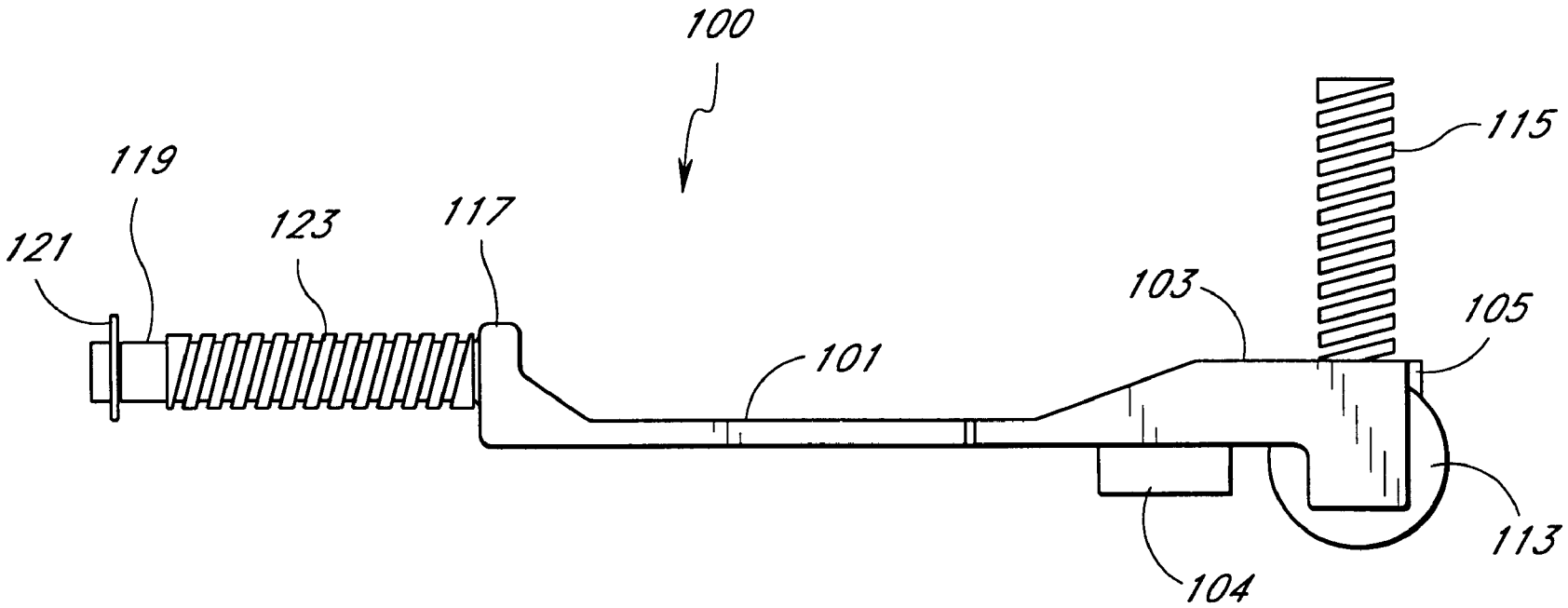
FIG. 3 is a side view of the roller unit of FIG. 2.

FIG. 3 shows a side view of the roller unit 100 of FIG. 2. This side view of roller unit 100 further reveals constructional aspects of a preferred embodiment roller unit 100. As discussed above, the roller unit 100 includes a body 101 and a right claw 103 extending from the body 101 at one end of the body 101. One of two roller wheels 113 is shown positioned in a channel formed between the right claw 103 and the middle claw 105. Extending upwardly from the right claw 105 is the first biasing spring 115. Extending from the bottom of the body 101 is a raised cylindrical boss 104. This boss 104 engages a slot on a bracket on the printer housing. As will be explained below in conjunction with FIG. 8B, this engagement keeps the roller wheel body approximately centrally positioned, while still allowing sufficient advantageous lateral movement.

Figure 4:
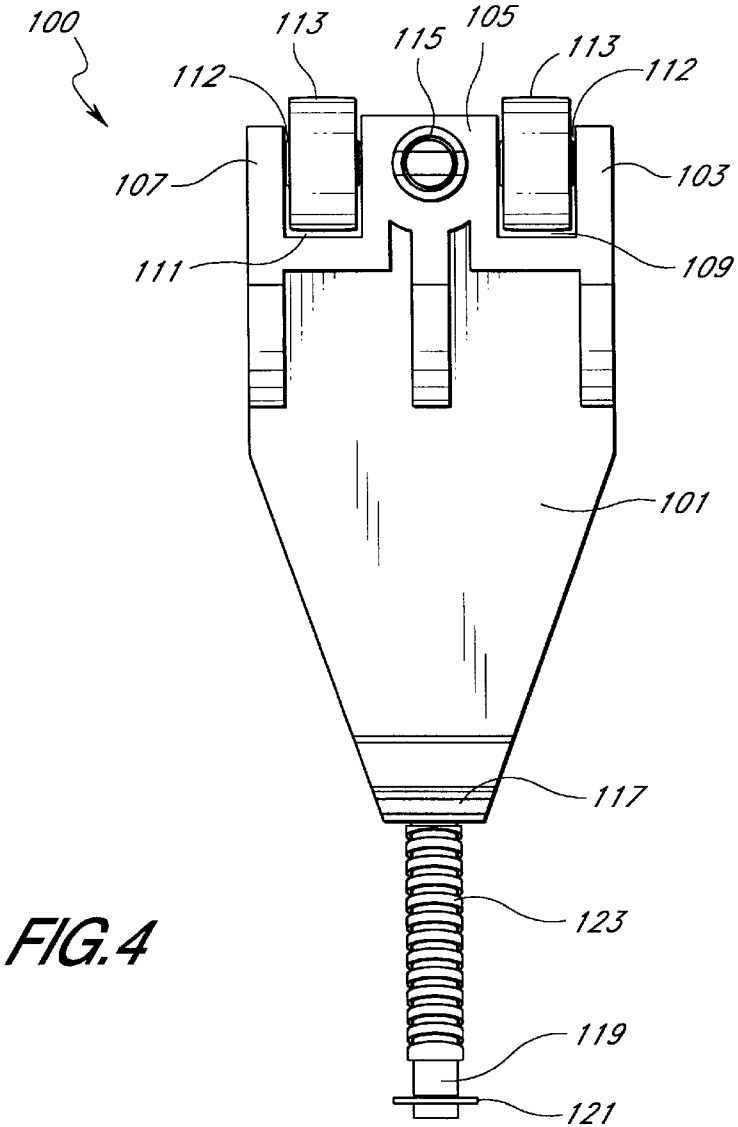
FIG. 4 is a top view of the roller unit of FIG. 2.

Referring now to FIG. 4, a top view of the roller unit 100 of FIGS. 2 and 3 is shown, where the same reference numerals are used for the same parts throughout. This top view reveals that, in a preferred embodiment, the shape of the body 101 becomes tapered at the end where the heel 117 is connected. As mentioned above, an axle 112 extends across the claws 103, 105, 107, on which the wheels rotate. The upawardly extending spring 115 rests on the axle 112 through a hole in the middle claw 105.

Figure 5:
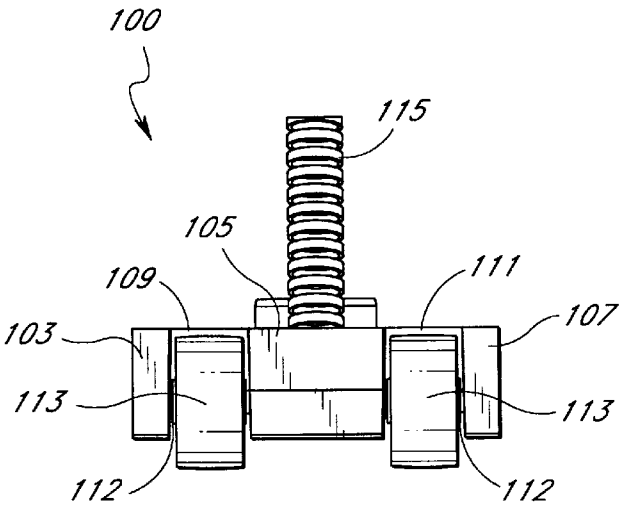
FIG. 5 is a front view of the roller unit of FIG. 2.

FIG. 5 illustrates a front view of the roller unit 100 of FIG. 2. This view further reveals the respective dimensions of a preferred embodiment roller unit 100 which includes roller wheels 113 positioned within respective channels 109 and 111 formed by the claws 103, 105 and 107.

Figure 6:
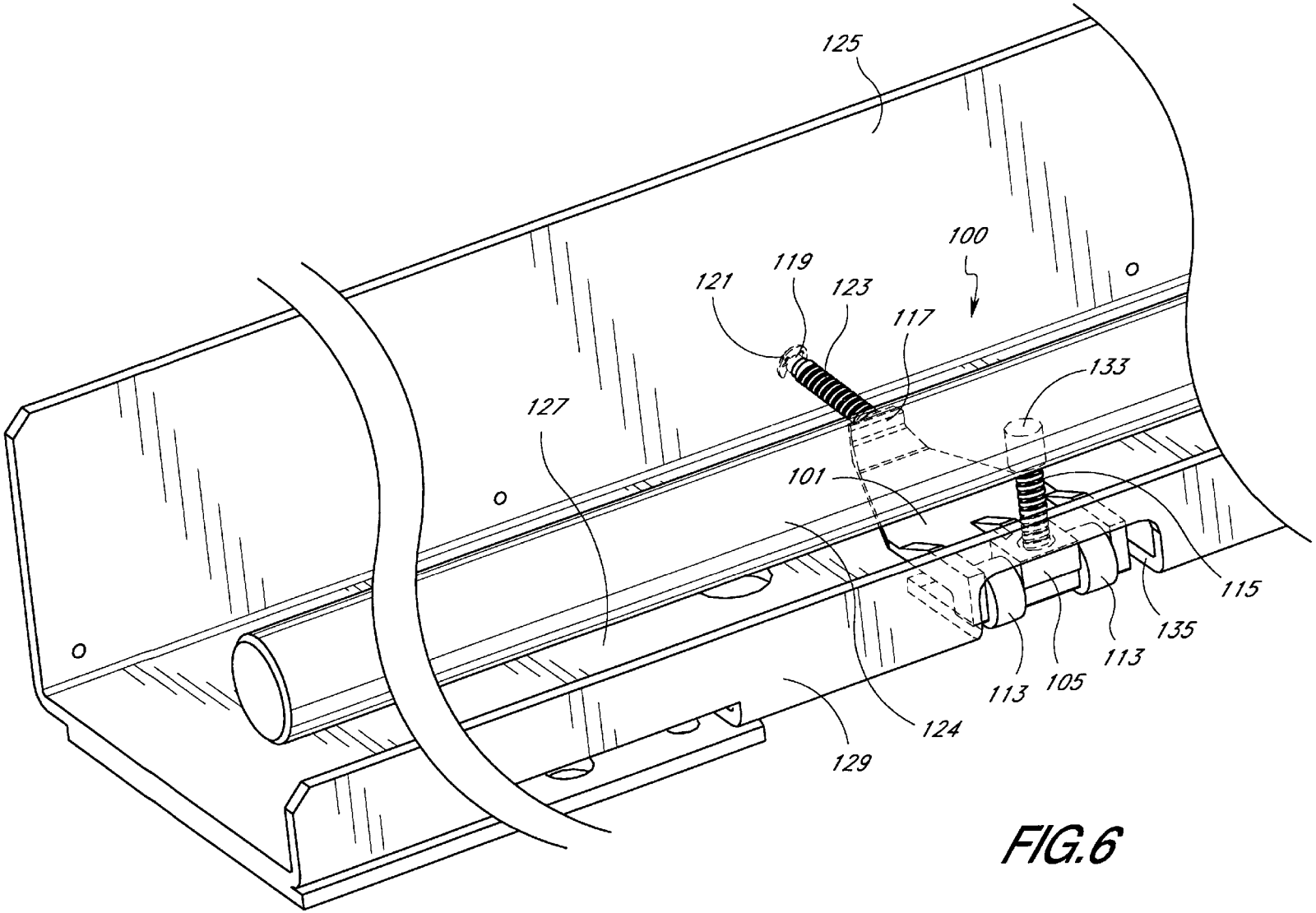
FIG. 6 is a perspective view of the roller unit of FIG. 2 positioned within a housing of a printer.

FIG. 6 shows the roller unit 100 of FIG. 2 coupled to a bracket structure of an inkjet printer. In the preferred embodiment shown in FIG. 6, the roller unit 100 is coupled to a rear bracket wall 125. As explained above, the rear end of the roller unit 100 is coupled to the rear bracket wall 125 with the cylindrical rod 119, the retainer washer 121 and the second biasing spring 123. The cylindrical rod 119 passes through a hole within the rear bracket wall 125 which is slightly larger in diameter than the diameter of the rod 119. The retainer washer 121 which is connected at the far end of the second cylindrical rod 119 prevents the rod 119 from being pulled out of the hole of the first support wall 125. Therefore, the rear bracket wall 125 is positioned between the retainer washer 121 and the second biasing spring 123 such that the roller unit cannot be pulled away from the rear wall 125, but can still pivot somewhat up and down and to the right and to the left, and can also rotate about the common longitudinal axis of the rearwardly extending rod 119 and surrounding spring 123.

In one embodiment, the rear bracket wall 125 extends from a bracket floor 127 which is connected at a bottom edge of the rear bracket wall 125 and extends perpendicularly to the rear wall 125, thereby forming an L-shaped cross-section between the rear wall 125 and the floor 127. The roller unit 100 extends outwardly from the rear bracket wall 125 and above the bracket floor 127.

The bracket also comprises a front wall 129, which extends upwardly from the floor 127 toward the front portion of the printer. A window 135 is formed in the floor 127 and the front wall 129 such that the roller wheels 113, and the claws 103, 105 and 107, of the roller unit 100 are positioned to make contact with a surface of recording media such as paper passing underneath the bracket floor 127. The portion of the window 135 in the bracket floor 127 includes a slot portion beneath the roller unit body 101 that is not visible in FIG. 6. This slot is described in more detail below with reference to FIG. 8B.

The upper end of the first biasing spring 115 is inserted into a hole 133 drilled part way through the guide rod 124 from the bottom. As can be seen with reference to FIG. 1 above, the print carriage 22 is affixed to a split sleeve 36 which is mounted to the guide rod 24. This split sleeve 36 is open at the bottom, so that the carriage 22 passes freely up and down the guide rod without hitting the biasing springs 115 which extend up from the roller units 100 which are positioned along the width of the platen 18.

The roller units of the invention are thus resiliently secured with six degrees of freedom. The securement of the cylindrical rod 119 in the rear bracket wall 125 is loose enough to allow some pivot of the body 101 about that connection point in the up and down directions and the left and right directions. In this way, the rear of the roller unit body 101 is pivotally attached to the rear bracket wall 125. Furthermore, the roller unit body 101 can rotate about the longitudinal axis of the cylindrical rod 119. The dual rollers 113 distribute the guiding force between these rollers, resulting in a more stable roller unit, and less tendency to misalign with the moving media. In addition, distributing the downard pressure over two roller wheels produces the same frictional force between the media and drive wheels beneath the media, with less tendency to create roller wheel indentations in the media. While the specification embodiment shown includes two roller wheels 113, it can be appreciated that three or more could also be used with similar affect. A significant feature of this invention is that precise alignment of each roller wheel during manufacture is not required as the first and second biasing springs 115, 123 bias the roller units 100 outward and downward over the media to bias the rollers in a nominally aligned configuration. When paper is being printed on, the paper motion forces the roller units 100 into a position consistent with paper motion as it is driven by the drive rollers 19, thereby preventing roller unit misalignment from interfering with proper media travel over the platen.

Figure 7:
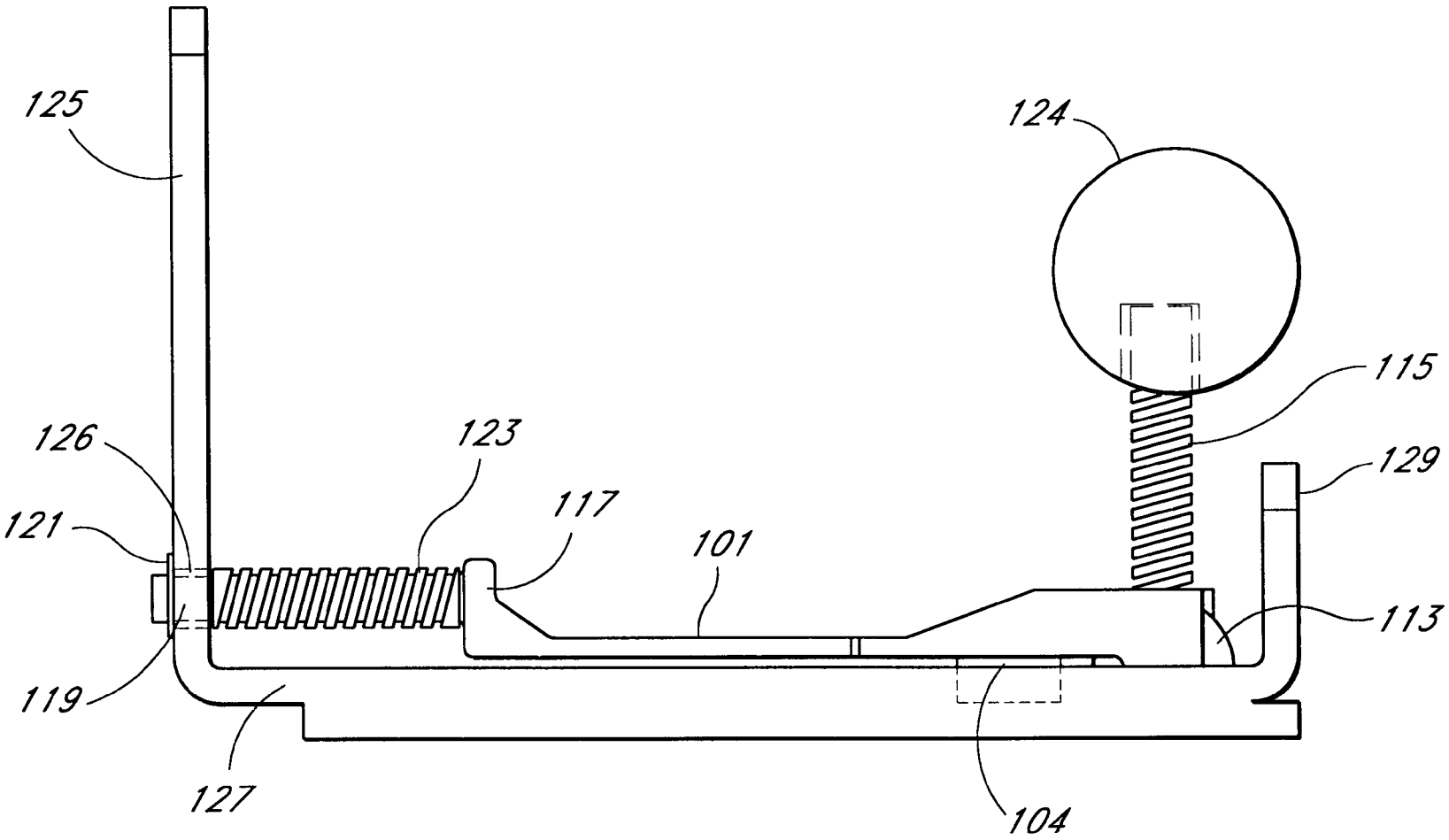
FIG. 7 is a side view of the roller unit of FIG. 2 positioned within a housing of a printer.

FIG. 7 shows a side view of the roller unit 100 attached to a support structure connected to the housing of the printer. As explained briefly above, the roller unit 100 includes a body 101 having at least one roller wheel 113 coupled to a first end and a heel portion 117 extending upwardly and perpendicularly to a top surface of the body 101 coupled to an opposite end. Extending outwardly from the heel portion 117 is the cylindrical rod 119 which is received through a hole 126 of the first wall 125. The cylindrical rod 119 is fixed in position with respect to the first wall 125 by means of the retainer washer 121. As can be appreciated, the diameter of the retainer washer is greater than the diameter of the hole 126 such that it prevents the rod 119 from being pulled out of the hole 126. The second biasing spring 123 surrounds the cylindrical rod 119. The first biasing spring 115 is coupled to the roller unit body 101 so as to bias the roller wheels 113 downwardly in order to make contact with the surface of a piece of paper passing underneath the roller wheel 113.

In an alternative embodiment, the body of the pinch roller mechanism of the present invention is biased downward without the first biasing spring 115. Referring to the side view of FIG. 7, it can be appreciated that a plastic body 101 which is substantially flat prior to installation can be configured and mounted so as to be forced to bend upward from the hole in the rear bracket wall 127 out to the rollers 113 after mounting into position. Resistance to this upward bend in plastic body material would force the rollers 113 to press downward with resilient pressure. In some advantageous embodiments, the shape, thickness, and material of the body is specified so that the arch between the rear bracket wall 125 and the rollers 113 consistently produces a desired downward pressure on the media with a high precision.

Figure 8A:
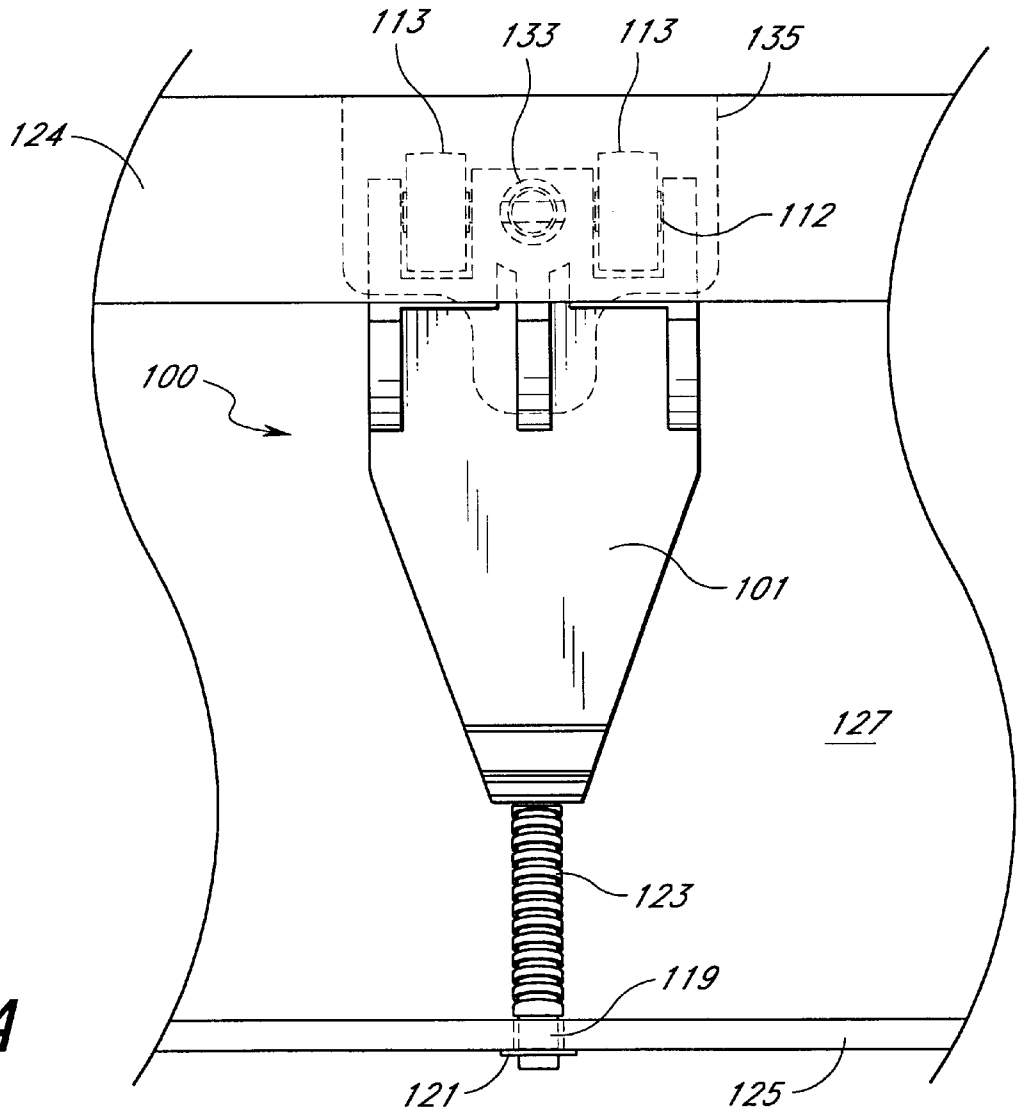
FIG. 8A is a top view of the roller unit of FIG. 2 positioned within a housing of a printer.

Referring now to FIG. 8A, a top view of the roller unit 100 is shown coupled to the bracket of the printer. The window 135 is cut into the floor 127 along the front wall of the bracket so as to expose the roller wheels 113 to the top surface of a piece of paper or other media which passes underneath the bracket floor 127. Only one roller apparatus 100 is illustrated, although as mentioned above, a plurality of roller apparatuses 100 are preferably placed in spaced relation along the platen 18 of a printer, similar to the single roller apparatuses 50 illustrated in FIG. 1.

Figure 8B:
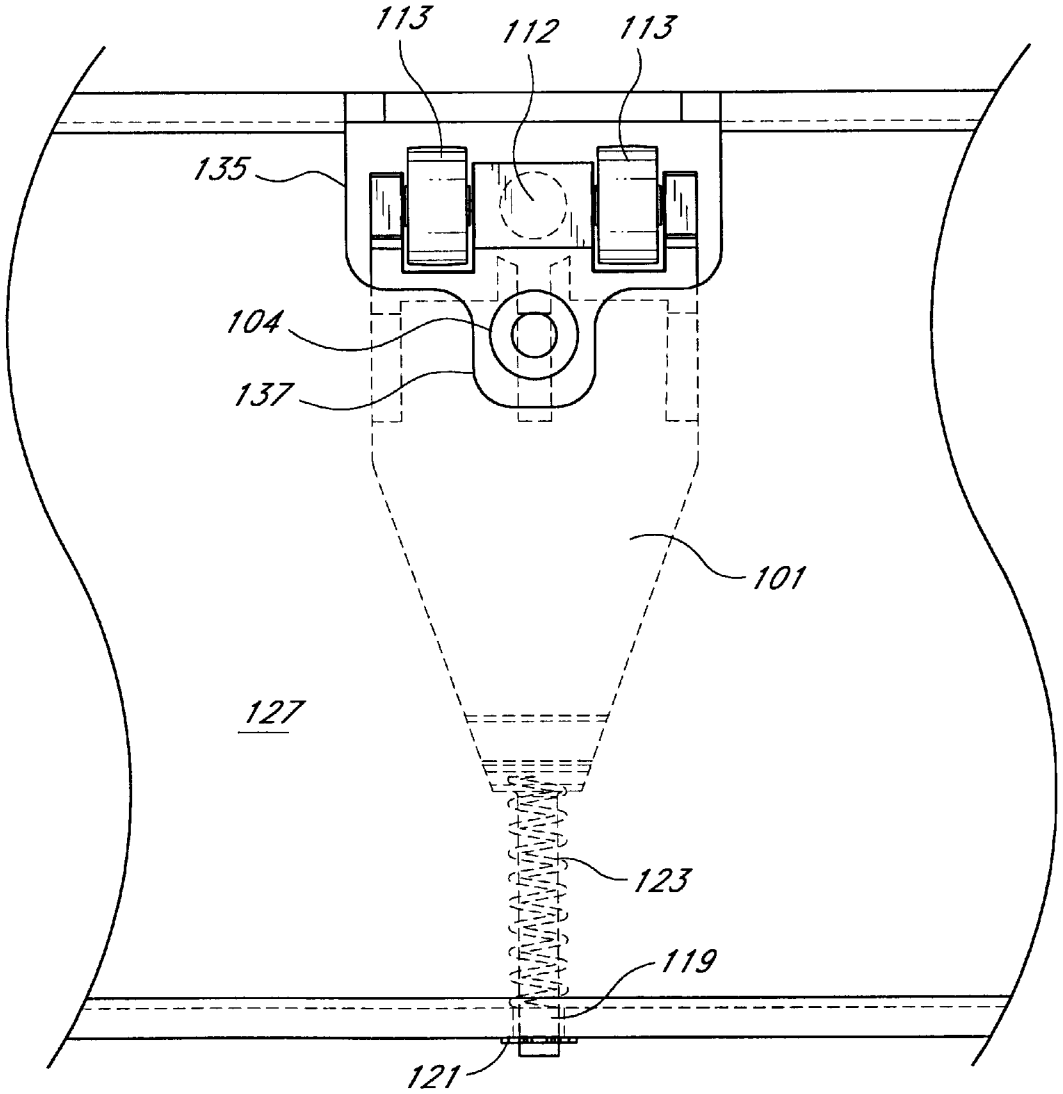
FIG. 8B is a bottom view of the roller unit of FIG. 2 positioned within a housing of a printer.

FIG. 8B illustrates a bottom view of a roller unit 100 in the same configuraton as in FIG. 8A described above. As is illustrated in this Figure, the roller wheels 113 are positioned in the window 135 formed in the bracket front wall 129 and bracket floor 127. The portion of the window 135 which is cut out of the bracket floor 127 includes a rearwardly extending slot 137 in which the boss 104 on the bottom of the roller unit body 101 is captured. Although the slot 137 is significantly wider than the diameter of the boss 104, the edges of the slot 137 prevent the roller unit body 101 from deviating too far from a central position within the window 135. This feature is especially avantageous during and after the performance of media loading operations from the front side of the printer. In these operations, the media is moving backwards through the printer as the media is loaded. Because of the backward media motion and the freedom of movement provided by the pivotal attachment of the rod 119, the roller unit may deflect laterally as it tries to "turn around" to follow the media motion. If this lateral motion is not limited by the boss 104 inserted in the slot 137, a significant amount of subsequent forward media motion may be required before the roller unit body 101 is again approximately centrally located within the window 135. Preventing excessive lateral deflection of the roller unit body 101 helps ensure that the roller unit 100 is able to align with forward media motion quickly when printing is initiated.

Figure 9:
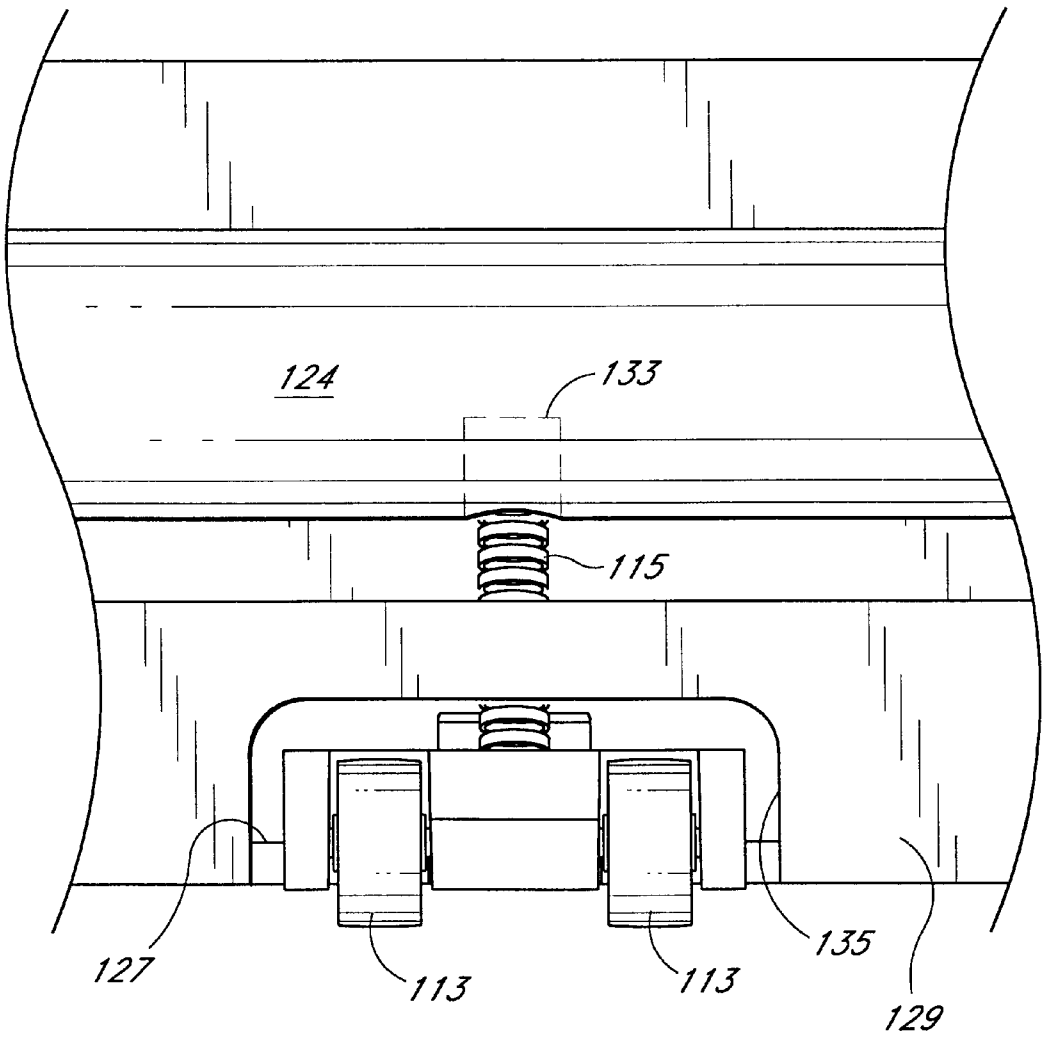
FIG. 9 is a front view of the roller unit of FIG. 2 positioned within a housing of a printer.

FIG. 9 shows a front view of the roller unit 100 as it is positioned within window 135. As shown in FIG. 9, the roller wheels 113 and claws 103, 105 and 107 of the roller unit 100 are positioned within the window 135. The first biasing spring 115 is shown positioned within a hole 133 drilled in the bottom of the guide rod 24, and biases the roller wheels 113 downwardly to make firm contact with the surface of the media passing underneath the roller wheels 113.

The pinch roller of the invention thus continually remains aligned with media as it is fed through the printer, but rather, thereby avoiding misalignment problems produced in prior art roller apparatus. The invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed is:

1. A printer comprising:

a horizontal platen on which media is mounted;

a support structure mounted above said horizontal platen;

a plurality of roller units coupled to a lower portion of said support structure and extending outward from said lower portion of said support structure in the direction of media travel, and wherein said roller unit comprises a rearwardly extending portion surrounded by a spring, and further wherein said rearwardly extending portion is pivotably coupled to said support structure; wherein at least one of said roller units comprises a plurality of roller wheels.

2. The printer of claim 1, wherein all of said roller units comprise a plurality of roller wheels.

3. A printer comprising:

a horizontal platen on which media is mounted;

a support structure mounted above said horizontal platen;

a guide rod for mounting a print carriage; and a plurality of roller units coupled to a lower portion of said support structure and extending outward from said lower portion of said support structure in the direction of media travel, wherein at least one of said roller units comprises a plurality of roller wheels, and wherein at least one of said roller units is biased downward toward said platen by a spring extending between said guide rod and said roller unit.

* * * * *